US005934455A

United States Patent [19]

Vuorinen

[11] Patent Number: 5,934,455

[45] Date of Patent: Aug. 10, 1999

[54] SWITCH DEVICE

[75] Inventor: Valto Vuorinen, Vaasa, Finland

[73] Assignee: ABB Control Oy, Vassa, Finland

[21] Appl. No.: 08/981,039

[22] PCT Filed: May 22, 1996

[86] PCT No.: PCT/FI96/00281

§ 371 Date: Feb. 11, 1998

§ 102(e) Date: Feb. 11, 1998

[87] PCT Pub. No.: WO97/01181

PCT Pub. Date: Jan. 9, 1997

[30] Foreign Application Priority Data

Jun. 21, 1995 [FI] Finland ..... 953115 U

[51] Int. Cl.[6] ..... H01H 21/84

[52] U.S. Cl. ..... 200/430; 200/1; 200/16 R; 200/571

[58] Field of Search ..... 200/4, 6 R, 7, 200/11 R, 11 A, 11 G, 11 H, 11 K, 16 R, 16 A, 16 C, 16 D, 424, 428–433, 437, 564–566, 572, 323, 324, 325

[56] References Cited

U.S. PATENT DOCUMENTS 5,389,754 2/1995 Muller et al. ..... 200/292
5,491,311 2/1996 Muscat et al. ..... 200/4
5,736,698 4/1998 Mattlar et al. ..... 200/16 R

FOREIGN PATENT DOCUMENTS 0 219570 4/1987 European Pat. Off. ..... H01H 11/00
WO/95 05673 7/1994 WIPO ..... H01H 9/20

*Primary Examiner*—Michael A. Friedhofer

[57] ABSTRACT

A manually operated switch device with small operating play and precise function for the control of electrical equipment which includes a switch housing which has stationary contacts adapted thereto, and a contact bridging element with moving contacts which is adapted to be movable. The switch is operated by means of an actuating member which is movable in the interior of the switch housing and which is capable of transferring, by a rotational motion of the actuating member, the moving contacts for engaging and disengaging with the stationary contacts, and by means of a transmission means for converting the rotational motion of the actuating member into an axial motion. Springs are adapted to cooperate with the transmission means for exerting a spring force onto said transmission means for engaging and disengaging said contacts by having at least two springs located at the opposite sides of the actuating member for exerting a symmetrical spring force on said actuating member and said transmission means.

8 Claims, 5 Drawing Sheets

SWITCH DEVICE

This application claims the benefit under 35 U.S.C. §371 of prior PCT International Application No. PCT/FI 96/00281 which has an International filing date of May 22, 1996 which designated the United States of America, the entire contents of which are hereby incorporated by reference.

BACKGROUND OF THE INVENTION

The present invention is related to a manually operated switch device for the control of electrical equipment.

For switches employed in electrical equipment, the switch position or the switch status must be secured so that an uncontrolled change of the switch status cannot occur. An inadvertent starting of an electrical apparatus may occur due to, e.g., vibration or a strong shock which causes the movement of the switch into a wrong position resulting in dangerous, hazardous situations, such as the unintentional starting of equipment. Inadvertent switching-on of electric power in a circuit may also be hazardous during, e.g., maintenance operations. Correspondingly, unintentional toggling of a switch into the zero position, that is, switching off the current from an electric circuit may cause machinery damage due to uncontrolled stopping of actuators. Due to such problems, reliable latching of equipment switches in their ON and OFF positions, must be secure with the help of, e.g., spring-loaded means.

Positive latching of a switch position can be implemented by means of, e.g., a cam attached to the switch operating shaft, whereby the cam is followed by a spring-loaded lever. The lever is provided with a guide slot suited to accommodate a guide pin fixed to the body structure of the switch. The loading spring of the lever is adapted about the lever and compressed between the guide pin and the meeting point of the lever with the cam. When the switch is in its ON position or its OFF position, respectively, the spring latches the switch positively in its set position and prevents uncontrolled rotational motion of the switch operating shaft. As the switch operating shaft is rotated, the spring is compressed between the guide pin and the cam tip. After the cam tip is rotated into its top dead center position, the toggling point of the detent cam/lever system is attained and as the cam is further rotated over its TDC position, the spring pushes the cam and the attached operating shaft of the switch into its opposite position.

However, such a switch construction has some drawbacks. Although the spring can latch the switch positively in a correct position at the ends of the shaft rotational travel, the operation of the switch is rather uncontrolled in the middle of the shaft rotational travel. In the TDC position of the detent cam/lever mechanism, the spring force is oriented parallel to the longitudinal axis of the detent cam/lever combination, thus being exerted onto the switch operating shaft and not exerting a rotational force on the switch operating shaft and the guide pin. Consequently, this sector of the rotational travel forms an undetermined position of the switch setting, in which the switch may remain after operation by a careless user. The mutual friction between the switch members makes such a position uncontrollable and relatively easily permits the switch to assume this intermediate position. As the intermediate position coincides with the TDC position of the detent cam/lever mechanism, the position is quite labile. Therefore, a switch left in this intermediate position may readily toggle from this intermediate position due to, e.g., a small shock into either limit position. As a result, such an uncontrolled change of switch position can cause an inadvertent starting of equipment or switching-on of power in an electric circuit supposed to be at zero voltage. Obviously, a hazardous situation occurs.

In addition to the discussion above, a conventional switch has the drawback that the operating speed of the switch is dependent on the operator action. This property degrades the electrical performance specifications of the switch. When the switch is operated using, e.g., too low a torque, the switching action does not take place at a sufficient speed, whereby an arc will be formed between the contacts that can destroy the switch very quickly as the energy released by the arc obviously has the greater burning effect the longer the arc is maintained. In addition to inadvertent arcing, the switch can be willfully misused by keeping the switch in a position that makes a marginal connection via the burning arc. Obviously, such a misuse destroys the switch very rapidly.

Disclosed in FI Pat. No. 93,502 is a switch device in which the switch body is provided with at least one linearly movable slide member with contacts adapted to cooperate with the stationary contacts of the switch. To the slide member, via at least one spring-type member, is connected, parallel with the slide member, a movable spring-arming plate which during the motion of said plate causes the slide member to correspondingly move under the force exerted by said springs. While this switch device embodiment provides a reliable and rapid switching action and unambiguous position indication, the structure of the contact surfaces permits operation of this device alone at relatively low currents.

SUMMARY OF THE INVENTION

It is an object of the present invention to provide a switch construction offering distinct and secure latching in the OFF position and the ON position, respectively, during the operation of the switch and having blade-like contact surfaces.

It is a further object of the present invention to provide a switch construction in which the operating member always assumes a position clearly indicating the status of the switch contacts and is capable of actuating the switch contacts at a high speed independent of the manual actuating speed exerted by the operator.

It is still a further object of the present invention to provide a switch with a minimal operating play and precise function.

The goal of the present invention is achieved by controlling the contact bridging element of the switch device by means of a symmetrical torque-exerting mechanism.

The symmetrical torque-exerting mechanism forces the contact bridging element to move along its center line and the slidable actuating members which control the bridging element are arranged to move in opposite directions, thus minimizing the accumulating effect of slackness due to the flexing and play of the members. The play in the toothed contact between the actuating member and the slide member can be minimized. Thus, the operation of the switch becomes precise. The actuating torque is evenly divided between two torque-exerting mechanisms, and further, the wear on the cam tips of the release mechanisms and the slanted surfaces of the tipped elastic fingers of the slide member are reduced. Also the wear on the tips of the slide element elastic fingers and the limit stops on the switch cover will be reduced by virtue of the distributed stresses. Such a reduction of stresses imposed on the limit stops of the switch cover and the tipped elastic fingers of the slide member is particularly valuable, because these members have a small contact area and the tips have to keep the slide members stationary during the arming of the springs until the moment of tripping. Due to the symmetrical structure, the moving contacts meet their stationary contacts simultaneously, which is important in closing the switch to a short-circuit load and breaking up a load current. Further, simultaneous operation of the contacts also results in uniform wear of the contacts. The position indication will be positive and reliable as the position indication limiters abut the limit stops of the contact bridging element in both limit positions.

The actuating member stays on the center line, because it simultaneously controls two torque-exerting mechanisms actuating with identical torques. This arrangement prevents lateral yielding deformation of the actuating member. When the number of the slide members is two, the load imposed on the toothed torque-transmitting mechanism is halved. More space is provided for the motion of the bridging element in the direction of the actuating member axis and for a larger contact opening gap. The actuating member can be recessed deep into the bridging element, since the arrangement of symmetrically exerted torque relieves the member from lateral forces that could cause friction and thereby degrade the operating precision of the switch device. The actuating member shaft can have a long adjustment span, whereby the actuating knob can be positively secured to a long shaft, thus avoiding the use of special-design shafts. The paired guide slots for the slide members moving the bridging element can be provided with a steep pitch angle due to the opposite direction motion of the slide members. Particularly advantageously, the guide slots are provided with a variable pitch angle formed into, e.g., circular arcs.

Due to the dual torque-exerting mechanism construction, the present switch device will function even when one of the torque-exerting mechanisms is damaged or the limit stop on the cover is worn or otherwise broken. In such a situation, the other torque-exerting mechanism has to bear a doubled mechanical load, whereby its wear rate is obviously accelerated. Nevertheless, this property allows the service of the switch device to be extended as necessary in cases that do not permit immediate replacement of a damaged switch with a new device. Said property also improves reliability and operating safety, because no instantaneous damage and loss of function can occur in the switch device, but instead, current switching and breaking can in most cases be made even with a partly damaged switch.

BRIEF DESCRIPTION OF THE DRAWINGS

In the following, the invention will be examined in more detail with reference to the attached drawings, in which.

DETAILED DESCRIPTION OF THE INVENTION

Figure 1:
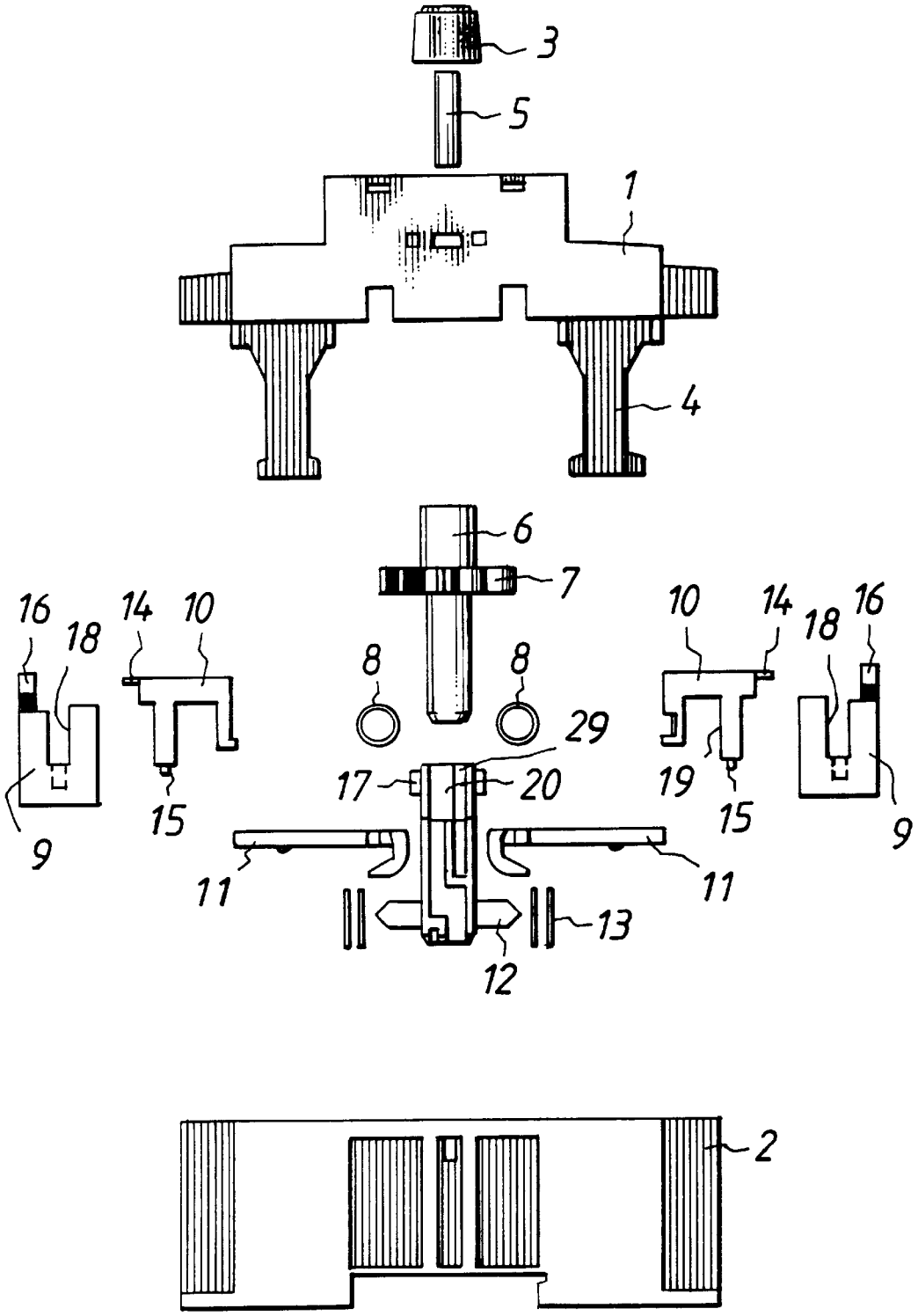
FIG. 1 is an exploded view of a switch device according to the present invention.

Referring to FIG. 1, the housing of the switch device is comprised of a cover 1 and a body 2. The cover 1 has fastening clips 4 which are insertable into compatible holes of the body 2 thus fixing the cover in place. It should be noted that while in reality the cover 1 and the body 2 form a closed housing except for the entry holes of the cables, for purposes of illustration the annexed diagrams show views with cut-out windows to facilitate an easier description of the functions of the switch elements.

Still referring to the exploded view of FIG. 1, the principal elements of the switch device are shown therein. Stationary contacts 11 and quenching plates 13 are attached to the body 2 and the moving contact bridging element 20 is disposed between them so that the contacts 12 of the bridging element are located below the stationary contacts 11 and between the quenching plates. The actuating member 6 is adapted to move into the opening of the bridging element 20, and slide members 9 supported by the guide pins 17 are provided at both sides of the bridging element. The slide members 9 have trip elements 10 which fit into their corresponding slots 18 so that the flanges 19 of the trip elements 10 are located in the slots 18 of the slide members 9. The slide members 9 and the trip elements 10 are also provided with a space suitable for accommodating torque-generating springs 8. The slide members, trip elements and springs together form the torque-exerting mechanism of the switch device.

Figure 2:
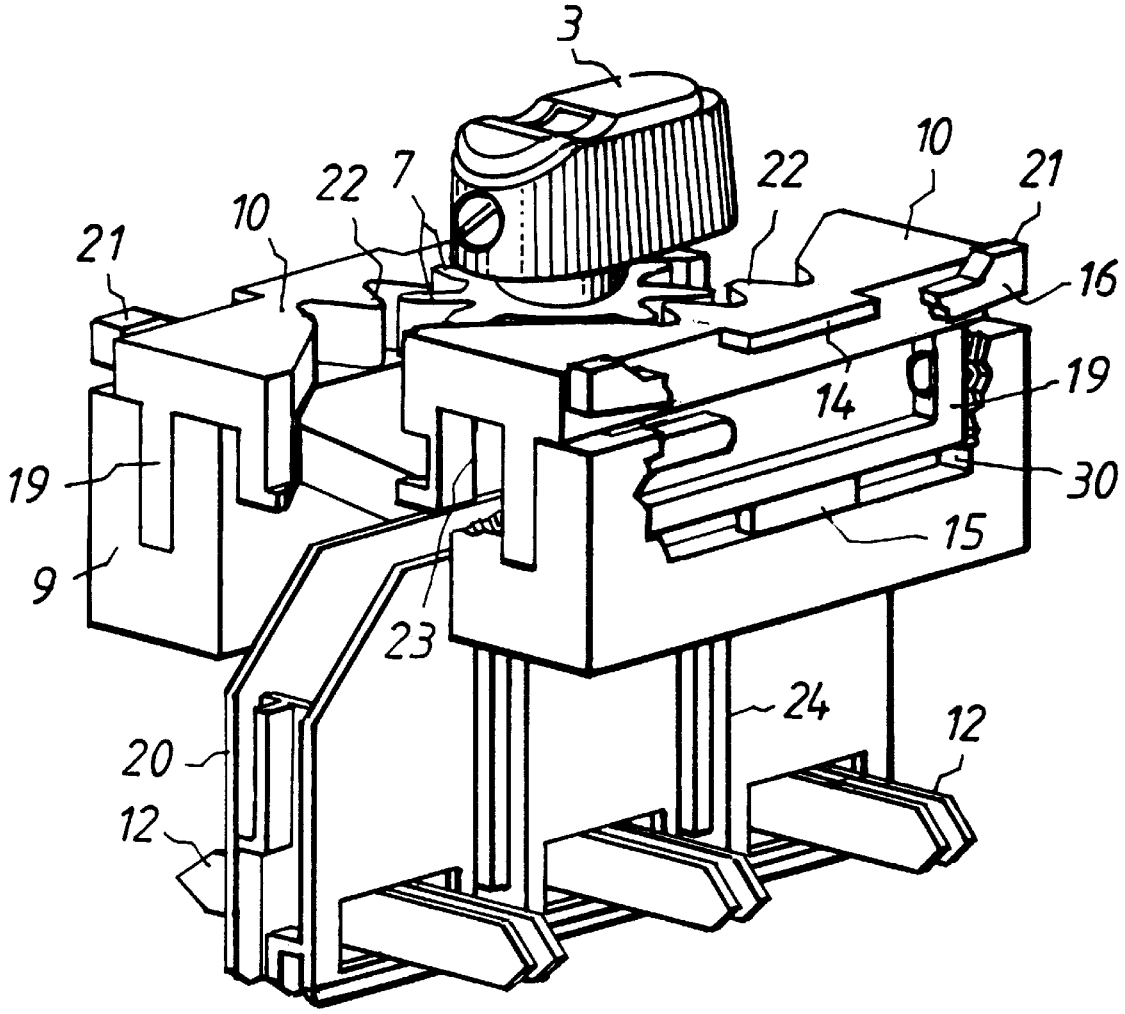
FIG. 2 is a perspective view of a group of elements of the switch device illustrated in FIG. 1 assembled together.
Figure 3:
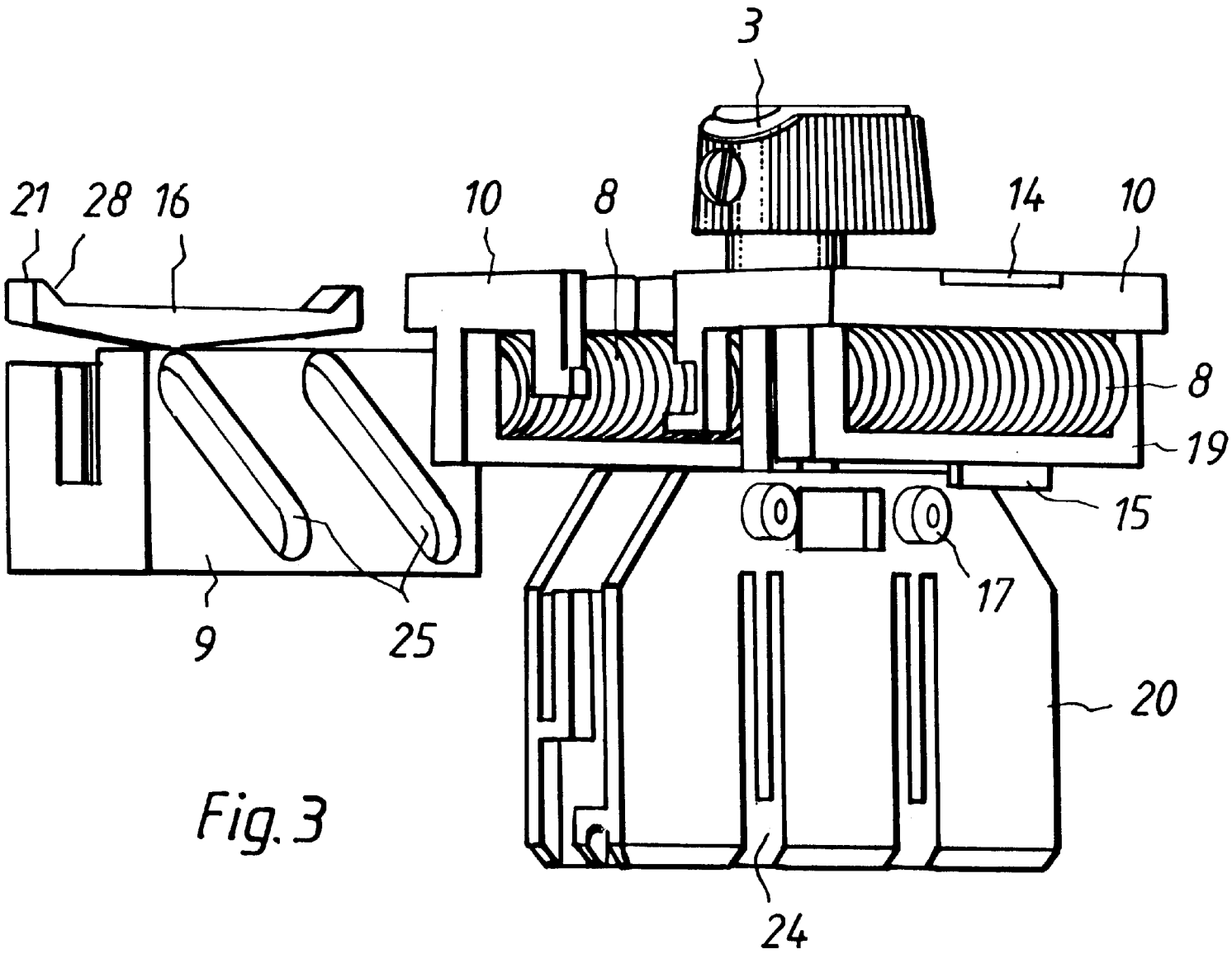
FIG. 3 is a perspective view of another group of elements of the switch device illustrated in FIG. 1 assembled together.
Figure 4:
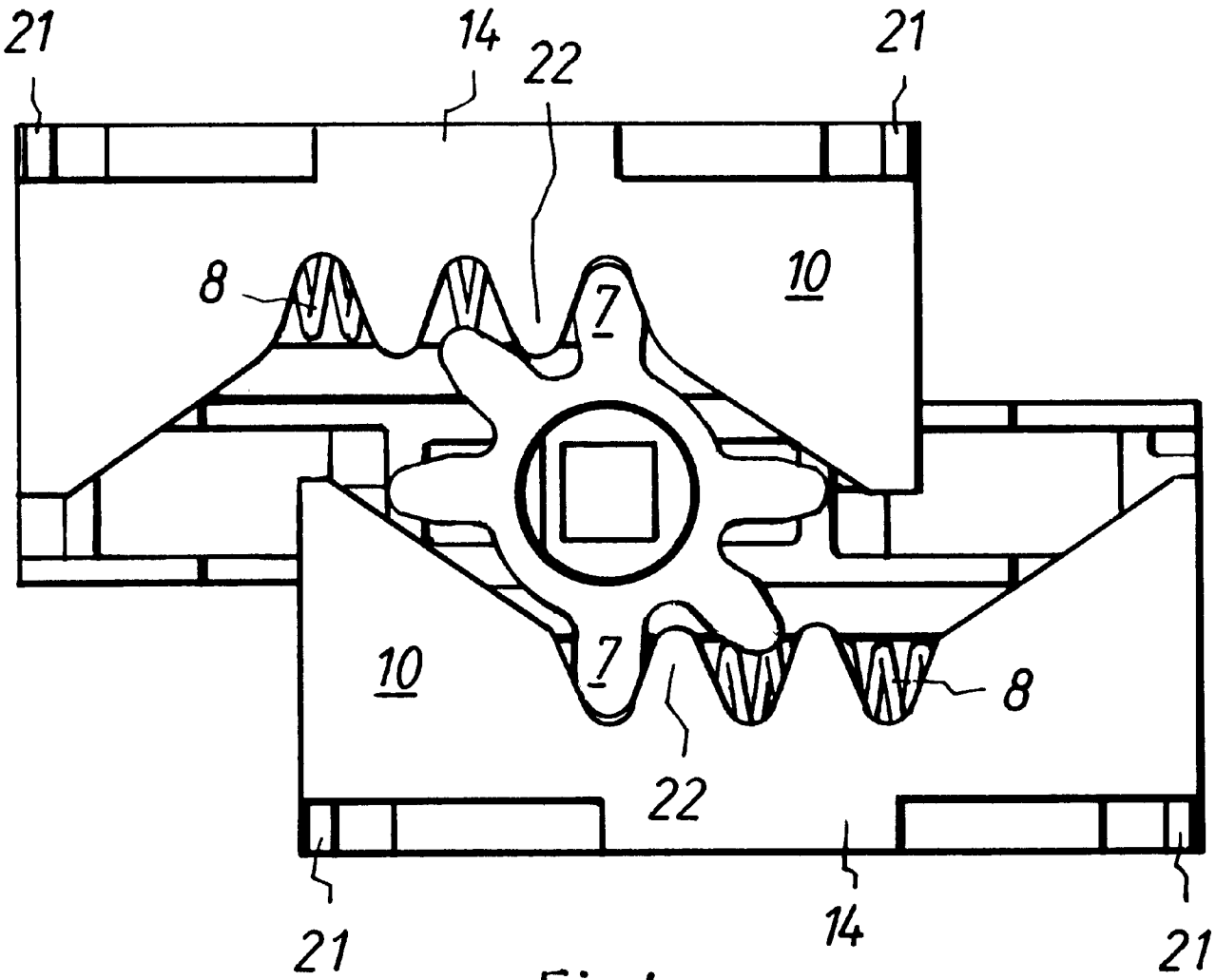
FIG. 4 is a top plan view of the toothed actuating mechanism of the switch device illustrated in FIG. 1.

In FIGS. 2 and 4 the bridging element 20 and the trip elements 10 are shown with their slide members 9. In FIG. 3 these switch device parts are shown in an exploded perspective view separate from each other. The flange 19 of the trip element 10 forms an annular recess providing a space for the torque-generating spring 8, and the slide members 9 incorporate a space suitable for accommodating the flange 19 of the trip element 10 and the spring 8 inserted therein. After the insertion of the spring 8 into the annular spring-accommodating space of the flange 19, the spring will be backed at the center line of its ends by the ends of the spring space in the flange. When the flange 19 with the spring 8 are inserted in the slide member 9, the ends of the spring-accommodating space coincide with the ends of the spring so that if the trip elements 10 are moved relative to the slide members 9 in the axial direction of the spring 8, the spring 8 will be compressed by the flange 19 and the slide member. In FIGS. 2 and 3 are also shown the guides 24 of the bridging element 20 that run on longitudinal stiffeners 31 extending to the interior of the body 2. The sliding elements 9 and the trip elements 10 slide in a ready-assembled switch device on the upper surfaces of the stiffeners 31. The inner surfaces of end hooks at one end of the trip elements have position limit stops 23.

As shown in FIG. 3, the motion of the bridging element 20 of the slide member 9 is guided by a pair of slanted slots 25. In a ready-assembled switch device, the guide pins 17 of the bridging element are adapted to run along these slots 25, whereby the longitudinal motion of the slide member forces the bridging element 20 to perform a vertical motion due to the oppositely located pair of guide slots with the guides 24 acting so as to support the motion. The motion of the slide member 9 is accomplished by means of the trip element 10, and the trip element 10 in turn is moved by means of a mechanism comprising the teeth 7 of the actuating member and the mating teething 22 formed on the side surfaces of the trip element 10. In the illustrated embodiment, the actuating member 6 has two sets of three teeth on the opposite sides of the actuating member 6 which are designed so as to mate with the teeth 22 of the opposedly located trip elements.

Figure 5:
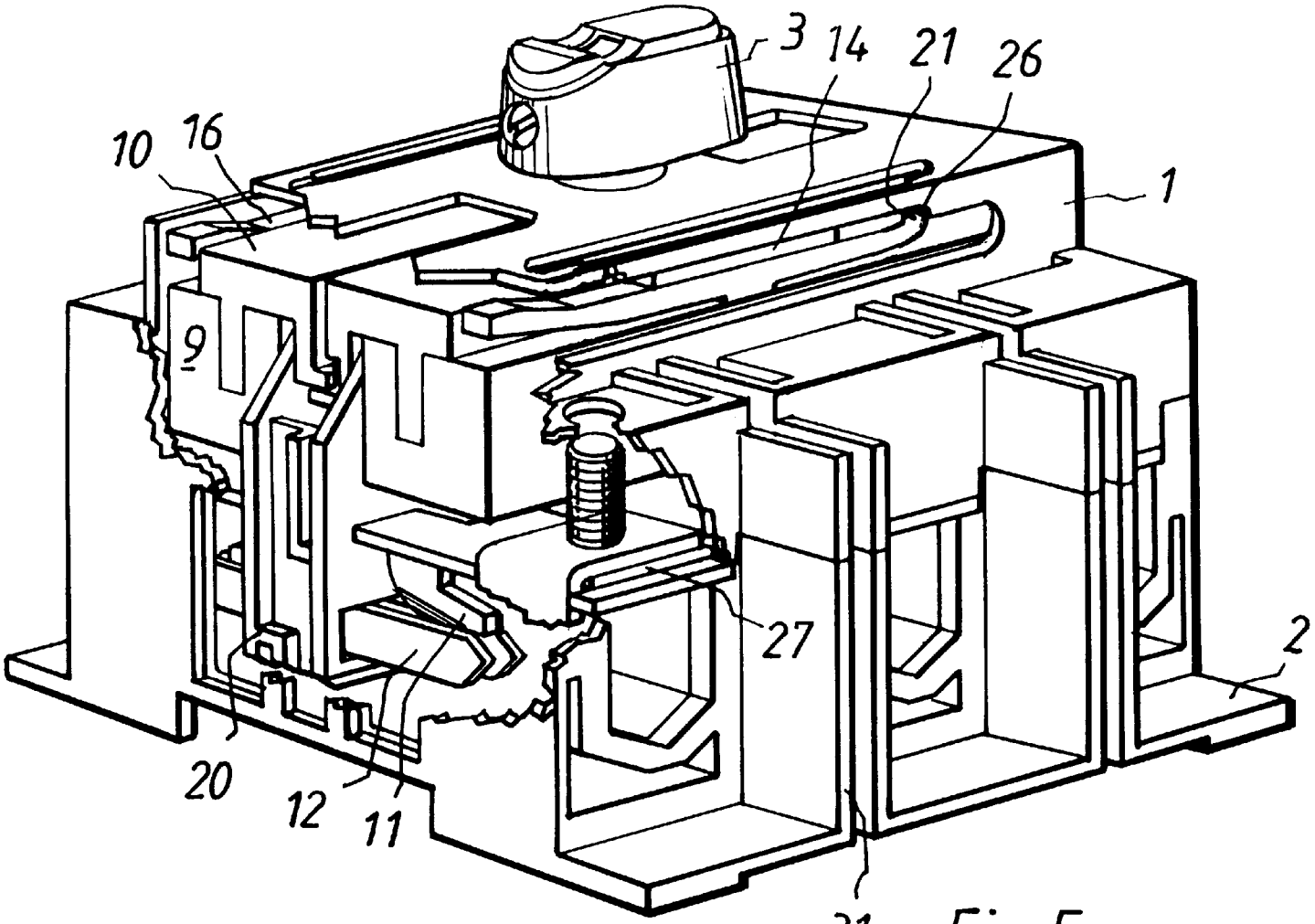
FIG. 5 is partially sectional perspective view of the switch device illustrated in FIG. 1.

Referring to FIG. 5, the switch cover 1 has backing surfaces 26 of the cover 1 adapted to rest against the stop surfaces 21 of the tipped elastic fingers 16 of the slide member 9 which halt the motion of the slide members during the arming of the springs 8. In the diagram of FIG. 5 are also shown cable terminal clamps 27, whose number in the switch device embodiment illustrated therein is three on both sides of the switch.

The switch embodiment described above is operated as follows. The arming of the torque-generating springs 8 and the motions of the different switch elements occur in an identical fashion when the switch is actuated into its ON and OFF positions, obviously using, however, reversed actuating directions. Because of the symmetrical operation of the switch device, the corresponding motions in both groups of mating parts take place on both sides of the actuating member 6. When the control knob 3 is resting in position 0 or 1, one of the stop surfaces 21 of the tipped elastic fingers 16 rests against the backing surface 26 of the cover. As the control knob 3 is rotated, the teeth 7 of the actuating member 6 transmit the rotational motion to the teeth 22 of the trip elements 10. Since the slide members 9 are still stationary, the trip elements 10 can compress the springs 8 located inside the slide members 9. Simultaneously, the trip element tips 14 move along the upper surfaces of the tipped elastic fingers 16 until meeting the slanted surfaces 28 of the fingers behind the stop surfaces 21. When the movement of the control knob 3 and the trip elements 10 is continued, the trip tips 14 release the tipped elastic fingers 16 from their locking to the cover thereby tripping the slide members 9. At this moment, the control knob 3 has moved to approx. a 60° angle of rotation. At the tripping of the slide members 9, they are moved at a high speed, horizontally pushed by the compressed springs 8 thereby actuating the bridging element 20 to move vertically under the support by the guide pins 17 of the slide member 9 running in the slanted slots 25. During this motion, the moving contacts 12 attached to the bridging element 20 are also moved, whereby the load current is switched on or off depending on the direction of the motion of the bridging element. Simultaneously, the stop surfaces 21 of the tipped elastic fingers 16 at the opposite sides are passed behind the backing surfaces of the cover 1, whereby the control knob locks to indicate the selected switch position. In either switch position the torque-generating springs 8 remain only slightly precompressed in the interior space of the slide members 9 and trip elements 10 with their ends brought to the same plane, whereby the switch will be relieved from extraneous static stresses.

In the event of inadvertent welding-together of the contacts 11, 12 for any reason, their force-controlled separation can be attempted. In the present switch embodiment such a forced control is implemented by means of force-control tips 15 provided on the trip elements 10. The force-control tips 15 move in a slot formed below the spring-enclosing recessed space of the slide member 9 and the length of the slot is dimensioned so that the force-control tips 15 do not normally hit the ends 30 of the slot. In the case the contacts 11, 12 are not separated under the force imposed by the springs 8, the force-control tips 15 can meet the ends of the slot, whereby contact separation can be attempted by imposing a higher manual force via the control knob 3 on the bridging element. Should the separation of the contacts fail, the control knob remains by an angle of approx. 25°, short of the switch-open position and returns to the switch-closed position when the control knob 3 is released. Should the contacts separate only incompletely, the position limit stops 23 of the trip elements 10 meet the stops 29 of the bridging element 20 and the control knob remains by an angle of approx. 20°, short of the switch-open position and returns into the switch-closed position when the control knob 3 is released. The angles of the control knob rotation cited above are obviously exemplary and dependent on the dimensions and motion timing of the switch.

In addition to the preferred embodiment of the present invention described above, the present invention can be implemented in a plurality of alternative manners.

Obviously, the appearance and design of the different elements of the switch device may be varied widely. The torque-generating springs may be selected from coiled springs, leaf springs and other elements capable of exerting a sufficient spring force. While the number of spring elements must be at least two, parallel spring elements can be used if desired so that the springs together form a single spring element in the torque-exerting mechanism. The shape and number of guiding slots actuating the contact bridging element of the slide member can be varied, and advantageously, the slots with a variable pitch angle can be utilized to generate a high torque, whereby a suitable design of the guide slot shape can assist the handling of the control knob. The guide slots may alternatively be designed into the contact bridging element, whereby the slide members must be provided with compatible pins or other guide elements.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

I claim:

1. A switch device comprising a switch housing, stationary contacts disposed within the switch housing, a contact bridging element with moving contacts which is movable in the interior of the switch housing, an actuating member which is movable in the interior of the switch housing for transferring by a rotational motion of the actuating member, the moving contacts for engagement and disengagement with the stationary contacts, a transmission means for converting the rotational motion of the actuating member into an axial motion, and first springs cooperating with said transmission means for exerting a spring force to said transmission means for engaging and disengaging said stationary and moving contacts, wherein at least two of said first springs are employed and located at opposing sides of the actuating member for exerting a symmetrical spring force on said actuating member and said transmission means.

2. The switch device as defined in claim 1, containing two of said first springs.

3. The switch device as defined in claim 2, wherein said transmission means comprises two identical torque-exerting mechanisms containing actuating springs, whereby the torque-exerting mechanisms are symmetrically disposed on opposite sides of said actuating member.

4. The switch device as defined in claim 1, wherein said transmission means comprises two identical torque-exerting mechanisms containing actuating springs, whereby the torque-exerting mechanisms are symmetrically disposed on opposite sides of said actuating member.

5. The switch device as defined in claim 4, wherein each of said torque-exerting mechanisms moves in a direction perpendicular to the plane of said contact bridging element each of said torque-exerting mechanisms including slide members containing slanted slots and said contact bridging element containing guide pins which movably fit in said slots, whereby the motion of said bridging element is accomplished by the motion of said slide members in cooperation with said slots and the guide pins.

6. The switch device as defined in claim 5, wherein said slide members contain tipped elastic fingers and said cover contains backing surfaces which define the path of the tipped elastic fingers so as to prevent uncontrolled motion of the slide members, each of said torque-exerting mechanisms further containing a trip element which moves relative to said slide members and has a trip tip which moves with one of said tipped elastic fingers so that the movement of the trip tip can release the one of the tipped elastic fingers from being locked by one of said backing surfaces.

7. The switch device as defined in claim 6, wherein each of said trip elements has a recessed space for accommodating a corresponding one the first springs and each of said slide members contains a recessed space for accommodating a portion of a corresponding one of said trip elements that houses said springs corresponding one of said first in a fashion that permits moving said corresponding one of said trip elements relative to each of said slide members in order to arm said one of said first springs spring.

8. The switch device as defined in claim 7, wherein each of said trip elements has a force-control tip and each of said slide members has two backing surfaces which coincide with the movement of the force-control tips so that the distance between the force-control tips and the backing surfaces is larger than the distance between the armed and tripped positions of said trip elements.

* * * * *